United States Patent [19]

Burton et al.

[11] 4,006,440

[45] Feb. 1, 1977

[54] TERMINAL STRUCTURE FOR ELECTROMAGNETIC CONTACTOR

[75] Inventors: Lawrence A. Burton, Oconomowoc; Peter Heuser, Hales Corners; Marquis B. Robinson, Milwaukee; Dennis Trendel, Mukwonago; Donald V. Zunft, Greendale, all of Wis.

[73] Assignee: Allen-Bradley Company, Milwaukee, Wis.

[22] Filed: July 21, 1975

[21] Appl. No.: 597,555

[52] U.S. Cl. ..... 335/132; 335/202

[51] Int. Cl.[2] ..... H01H 50/04

[58] Field of Search ..... 335/132, 202, 131, 133

[56] References Cited

UNITED STATES PATENTS

| | | | |
|---|---|---|---|
| 3,504,311 | 3/1970 | Mullen et al. | 335/132 |
| 3,564,466 | 2/1971 | Lawrence et al. | 335/132 |
| 3,673,525 | 6/1972 | Collins | 335/132 |
| 3,949,333 | 4/1976 | Freitag et al. | 335/132 |

*Primary Examiner*—Harold Broome
*Attorney, Agent, or Firm*—Quarles & Brady

[57] ABSTRACT

A contactor includes an actuator which is slidably mounted to a base and carries a set of movable contacts into engagement with a set of stationary contacts when an associated electromagnet is energized. The stationary contacts are located above the electromagnet and are connected to a set of contactor input terminals and a first set of contactor output terminals which extend through the top of the contact enclosure. A second set of contactor output terminals are mounted to the base below the electromagnet where they are easily connected to overload relays. A set of bus bars are mounted to the base and connect the first and second set of contactor output terminals.

2 Claims, 4 Drawing Figures

TERMINAL STRUCTURE FOR ELECTROMAGNETIC CONTACTOR

BACKGROUND OF THE INVENTION

The field of the invention is electrical switches, and more specifically, electromagnetically operated switches such as relays and line contactors which have a slidably mounted actuator for effecting engagement and disengagement of one or more sets of contact structures.

Electromagnetic contactors such as that disclosed in U.S. Pat. No. 3,134,869 issued to L. E. Lawrence on May 26, 1964, are commonly employed in motor controls. In such motor controls, the contactor typically includes a set of three main contact structures, or power poles, which are connected to carry three-phase power to the motor. In contactors such as that disclosed in the above cited patent, three-phase power is applied to a set of three input terminals which extend from the top of the contactor, and when the main contacts are closed, this power is delivered at a set of three output terminals which also extend from the top of the contactor. When used in a motor control circuit, overload relays are connected to the contactor output terminals to conduct load current. Overload relays such as that disclosed in U.S. Pat. No. 3,223,803, issued to R. E. Walters on Dec. 14, 1965, operate the contactor and open the main contacts when an overload current is detected. They are typically mounted directly beneath or alongside the contactor on a common mounting plate to conserve space. Lead wires must be hand connected between the output terminals of the contactor and the overload relay.

SUMMARY OF THE INVENTION

The present invention relates to an improved terminal structure for an electromagnetically operated switch which facilitates its connection to an overload relay. More specifically, the invention resides in a line contactor having a base which slidably supports an actuator that is operated along a vertical actuation axis by an electromagnet to open and close a set of main contacts disposed within a contact enclosure located above the electromagnet, the line contactor including input terminals disposed on the top of the contact enclosure, a first set of contactor output terminals disposed on the top of the contact enclosure, a second set of contactor output terminals disposed on the base and located below the electromagnet, and a set of bus bars which electrically connect the two sets of contactor output terminals and are mounted to the base and extend behind the actuator and its associated electromagnet.

The general object of the invention is to provide a terminal structure for a contactor which allows the contactor outputs to be connected directly to either a load or to an overload relay without additional hand wiring. Where overload relays are not used, the first set of output terminals may be connected. On the other hand, when an overload relay is required, it is mounted directly beneath the contactor and connects directly to the second set of contactor output terminals.

Another object of the invention is to provide a terminal structure for a contactor which allows it to either be interconnected with another contactor to form a three-phase reversing switch or to be connected directly to an overload relay. The first set of contactor output terminals may be interconnected with the output terminals on a second contactor as disclosed in U.S. Pat. No. 3,564,466 issued to L. E. Lawrence et al on Feb. 16, 1971 to provide a reversing switch. On the other hand, the second set of contactor output terminals may be directly connected to overload relays which are mounted beneath one of the contactors.

These and other objects and advantages of the invention will become apparent from the description which follows: In the description reference is made to the accompanying drawings which form a part hereof, and in which there is shown by way of illustration a preferred embodiment of the invention. Such embodiment does not necessarily represent the full scope of the invention, and reference is therefore made to the claims herein for interpreting the breadth of the invention.

DESCRIPTION OF THE PREFERRED EMBODIMENT

Figure 1:
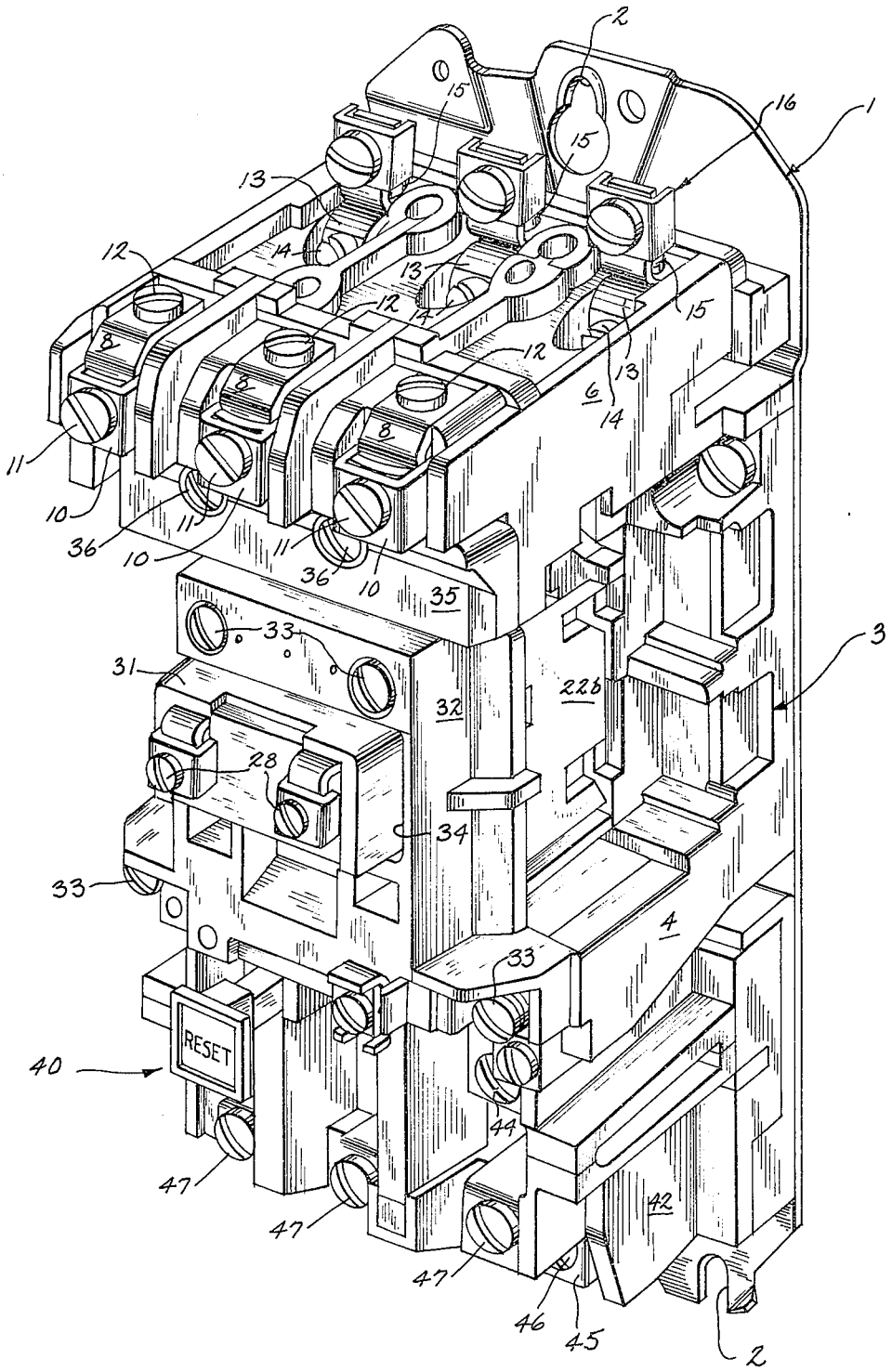
FIG. 1 is a perspective view of a contactor and associated overload relay which incorporates the terminal structure of the present invention.
Figure 3:
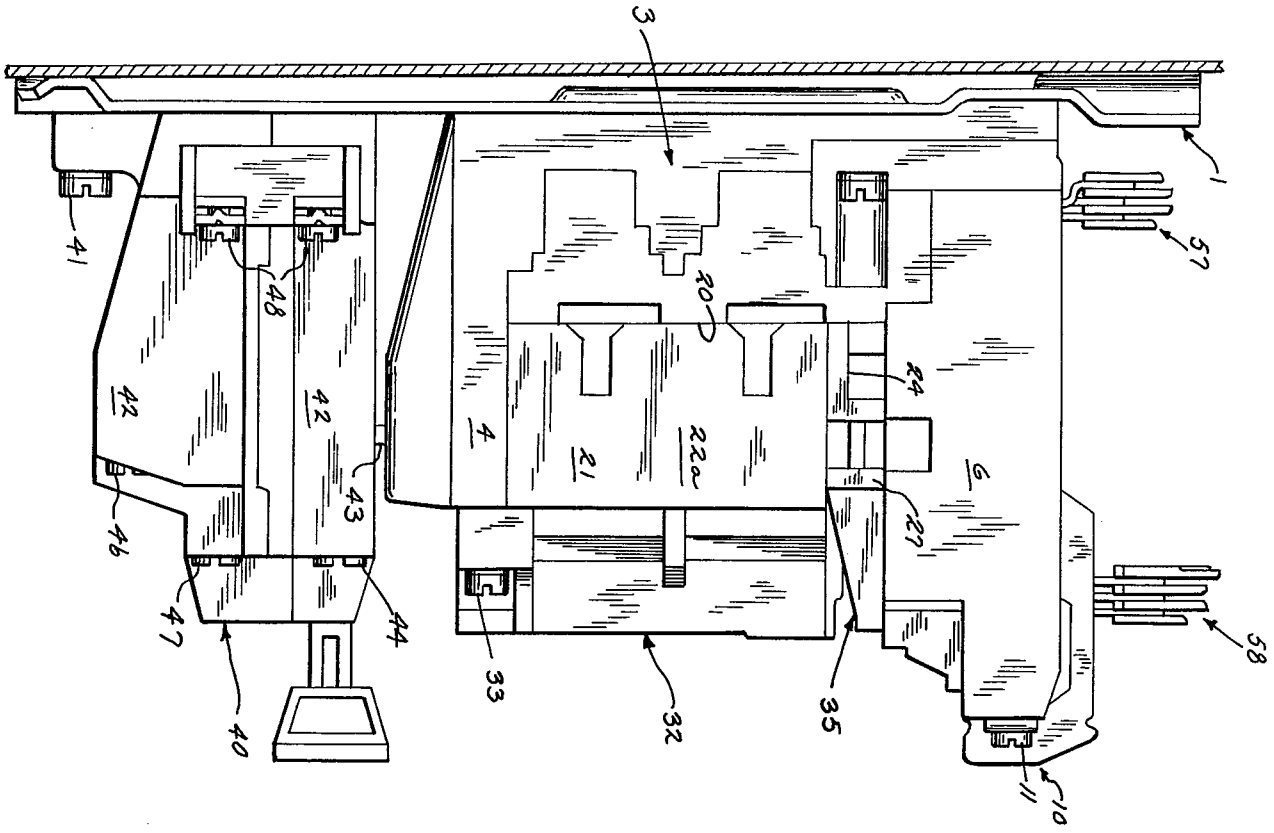
FIG. 3 is a side view of the contactor and associated overload relay shown in FIG. 2.
Figure 4:
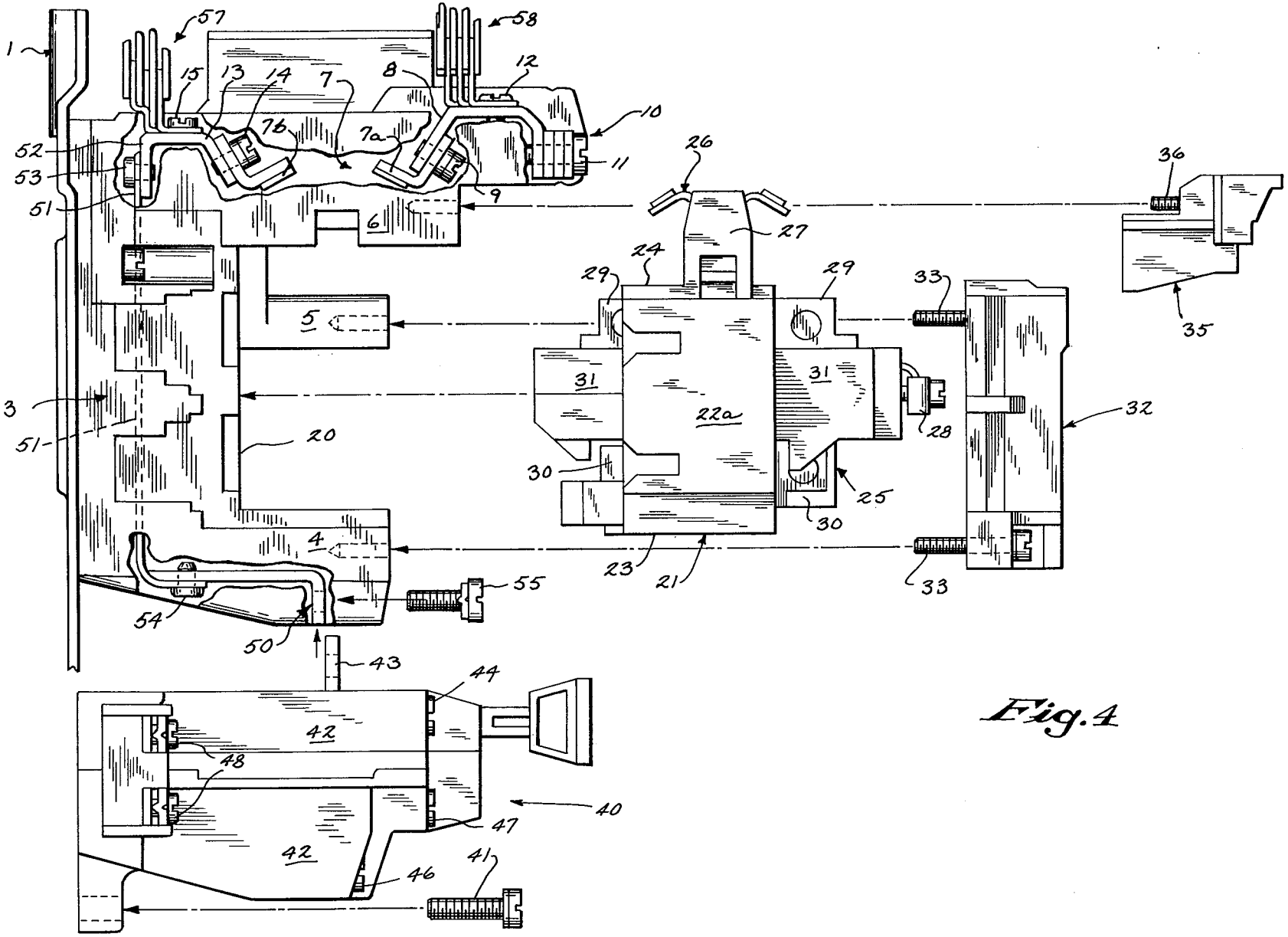
FIG. 4 is an exploded side view with parts cut away of the contactor and associated overload relay shown in FIG. 3.

Referring particularly to FIGS. 1, 3 and 4, the contactor includes a sheet metal mounting plate 1 having a set of apertures 2 for mounting on a panel or in an enclosure. A base structure 3 molded from a thermoset polyester insulating material is fastened to the mounting plate 1 and extends forward therefrom to provide the framework for the contactor. The base 3 includes an integrally molded terminal post portion 4 which extends forward from its lower end, a pair of integrally molded support posts 5 which extend forward from its mid section, and a molded line contact enclosure 6 which extends forward from the upper end of the base 3.

The contact enclosure 6 mounts three sets of stationary contacts 7, each of which sets includes an input contact **7*a* and an output contact 7*b*. Each stationary input contact 7*a* is connected to a metal strap 8 by a screw 9 and the straps 8 extend upward through the top of the contact enclosure 6 and are securely fastened thereto by bushings (not shown in the drawings) which are disposed beneath a set of mounting screws 12. The metal straps 8 wrap around the front edge of the contact enclosure 6 and support a set of contactor input terminal lugs 10 which are mounted by a set of terminal screws 11. The stationary output contacts 7*b* are mounted to metal straps 13 by a set of screws 14. The metal straps 13 are securely fastened to the contact enclosure 6 by a set of bushings (not shown in the drawings) which are disposed beneath a set of mounting screws 15. The mounting screws 15 also serve to secure a first set of contactor output terminal lugs 16 that extend upward from the top of the contact enclosure 6. The stationary line contacts 7 and their associated terminals 10 and 16** thus form a three-phase circuit in which the electrical conductance is controlled by the operation of the contactor.

Referring particularly to FIGS. 1 and 4, the base 3 forms a guideway indicated generally at 20 which slidably mounts an actuator 21 for operation along a vertical actuator axis. The actuator 21 is formed from molded polyester and includes a pair of spaced side walls 22*a* and 22*b* which are connected together by a bottom wall 23 and a top wall 24. The actuator 21 encloses an electromagnet 25 between the side walls 22*a* and 22*b* and it supports three sets of movable main contacts 26 which are mounted to an integrally formed support 27 that extends upward from the top wall 24.

The electromagnet 25 includes a magnetic circuit which is comprised of a stationary yoke 29 and a movable armature 30. The electromagnet 25 also includes a stationary coil structure 31 that surrounds the legs (not shown in the drawings) of the yoke 29. Electrical power is supplied to the coil 31 through a pair of input control terminals 28. One end of the stationary yoke 29 and coil structure 31 is received by the base 3 and the other end is received by a cover 32 which is fastened to the terminal post 4 and support posts 5 by a set of four screws 33. The cover 32 is formed of molded polyester and it includes a central opening 34 through which the coil structure 31 extends. A retainer element 35 formed of molded polyester is fastened to the front of the contact enclosure 6 by a pair of screws 36 and it serves to fully enclose the main contacts 7 and 26.

The actuator 21 slides along the actuator axis between a lower, or deenergized, position and an upper, or energized, position. During this stroke, the main movable contacts 26 are carried by the actuator 21 into contact with the stationary contacts 7, and during a portion of the stroke bias springs (not shown in the drawings) are compressed to provide contact pressure between the movable and stationary contacts 26 and 7. For a more detailed description of the actuator 21 and associated electromagnet 25, reference is made to the above cited U.S. Pat. No. 3,134,869.

A standard three-pole contactor has been described and is applicable in many situations where three-phase power lines are connected to the contactor input terminals 10 and a load is connected directly to the contactor output terminals 16. In most motor control applications, however, the contactor connects to the load device through a set of overload relays which monitor the current in each power line. Referring to FIGS. 1–4, the overload relays 40 are fastened to the mounting plate 1 by a pair of screws 41 and are positioned directly beneath the contactor. The overload relays 40 are mounted within a common housing 42 which is molded from a thermoset material. The housing supports a set of three input terminals 43 each of which is formed on the end of a metal strap that is fastened to the housing 42 by a screw 44. The housing 42 also supports a set of three relay output terminal lugs 45 which are fastened to a set of metal straps by screws 46. These metal straps are in turn mounted to the housing 42 by a set of three mounting screws 47.

As is well known in the art, the overload relays are responsive to the current flowing through them to deenergize the contactor and to thus open the three-phase circuit when a preset current level is reached. More specifically, the load is connected to the relay output terminals 45 and when the current becomes excessive in any one of the three phases, the corresponding overload relay operates to open the circuit between a pair of control terminals 48 that are disposed to the left side of the housing 42. These control terminals 48 are typically connected in series circuit with the input control terminals 28 on the contactor coil 31 and when they open circuit, the contactor is deenergized and the movable main contacts 26 drop out. For a more detailed description of the construction and operation of the overload relays 40, reference is made to the above cited U.S. Pat. No. 3,223,803.

To facilitate connection of the main line contacts 7 to the overload relays 40, a second set of three contactor output terminals 50 are provided on the terminal post portion 4 of the contactor base 3. Referring particularly to FIG. 4, the first and second contactor output terminal sets 16 and 50 are connected together by three metal bus bars 51 which extend downward from the contact enclosure 6 behind the electromagnet structure 25. The upper end of each bus bar 51 is fastened by a screw 53 to a downward turned portion 52 on the metal strap 13. The bus bars 51 are substantially enclosed by the base 3, but they bend forward at their lower ends and are substantially exposed on the bottom of the base 3. The contactor output terminals 50 are fastened to the bus bars 51 by screws 54, and each extends forward therefrom along the bottom surface of the base 3. A terminal screw 55 is received in a threaded opening formed in each terminal strap 50 along the forward edge of the base 3. The relay input terminals 43 are aligned with the contactor output terminals 50, and when mounted on a common mounting plate 1 therefor, the terminal screws 55 securely fasten them together without any hand wiring. In addition to the first set of contactor output terminals 16 which are located on the top of the contactor, therefore, a second set of contactor output terminals 50 are provided at its bottom where they conveniently connect to the overload relays.

Figure 2:
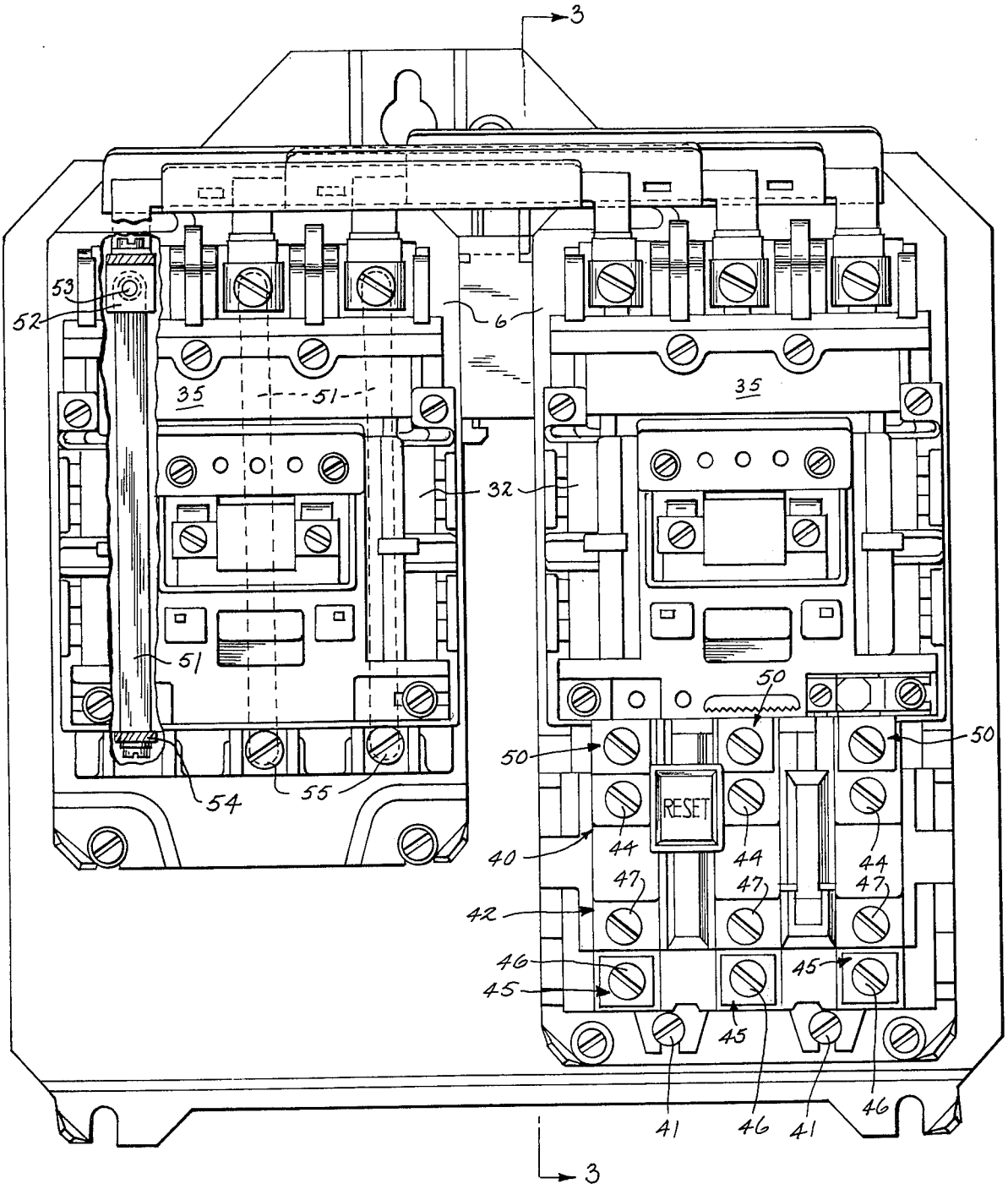
FIG. 2 is a front elevation view of two line contactors which incorporate the terminal structure of the present invention and which are interconnected to form a three-phase reversing switch.

The application of both sets of contactor output terminals 16 and 50 is illustrated in FIG. 2 which shows two contactors interconnected to form a three-phase reversing switch. As described in the above cited U.S. Pat. No. 3,564,466, the first output terminal lugs 16 on each contactor are replaced by a set of insulated connectors 57 which are fastened to the metal straps 13 by the mounting screws 15. The connectors 57 electrically connect the corresponding outputs of the two contactors. In addition, a second set of insulated connectors 58 are fastened to the input terminal straps 8 on both contactors by the mounting screws 12. The connectors 58 interconnect the inputs of the contactors such that the phase of the power applied to one contactor is the reverse of that applied to the other contactor.

Because only one motor is driven by the three-phase reversing switch, only one set of overload relays is needed. These are mounted beneath the right hand contactor where they connect with the second set of contactor output terminals 50 thereon. A compact and easily assembled reversing switch is thus provided in which extensive hand wiring is not required.

We claim:

1. In an electrical switch having a base which slidably supports an actuator for motion along a vertical axis, an electromagnet mounted to the base and being operable to slide the actuator upward along said axis when energized, a set of movable contacts mounted to said actuator, and two sets of stationary contacts mounted to said base within a contact enclosure which is disposed above said electromagnet, the improvement therein comprising:

a set of contactor input terminals mounted to said contact enclosure and electrically connected to one of said sets of stationary contacts;

a first set of contactor output terminals mounted to said contact enclosure and electrically connected to the other set of stationary contacts;

a second set of contactor output terminals mounted to said base and disposed beneath said electromagnet;

a set of bus bars mounted to said base and electrically connected to said second set of stationary contacts and said other set of contactor output terminals, said bus bars extending downward from their connection with said stationary contacts behind said electromagnet; and a set of overload relays mounted beneath the base and connected directly to said second set of contactor output terminals.

2. The electrical switch as recited in claim 1 in which said overload relays and said base are mounted to a common mounting plate and the input terminals on said overload relays are aligned to connect directly to the second set of contactor output terminals.

* * * * *